US010774856B2

(12) United States Patent
Yang et al.

(10) Patent No.: US 10,774,856 B2
(45) Date of Patent: Sep. 15, 2020

(54) DUST-PROOF AND HEAT-CONTROL DEVICE AND METHOD THEREOF

(71) Applicants: Guangdong Polytechnic Normal University, Guangzhou, Guangdong (CN); Shunqi Yang, Guangdong (CN)

(72) Inventors: Yong Yang, Guangdong (CN); Xiayun Liu, Guangdong (CN); Shunqi Yang, Guangdong (CN); Jun Yang, Guangdong (CN); Shaoming Luo, Guangdong (CN)

(73) Assignees: Guangdong Polytechnic Normal University, Guangzhou (CN); Shunqi Yang, Guangzhou (CN)

( * ) Notice: Subject to any disclaimer, the term of this patent is extended or adjusted under 35 U.S.C. 154(b) by 0 days.

(21) Appl. No.: 16/435,211

(22) Filed: Jun. 7, 2019

(65) Prior Publication Data

US 2019/0285096 A1 Sep. 19, 2019

Related U.S. Application Data

(63) Continuation of application No. PCT/CN2017/115018, filed on Dec. 7, 2017.

(30) Foreign Application Priority Data

Dec. 8, 2016 (CN) ..... 2016 1 1121334

(51) Int. Cl.
*F15B 15/14* (2006.01)

(52) U.S. Cl.
CPC ..... *F15B 15/1485* (2013.01); *F15B 15/1461* (2013.01)

(58) Field of Classification Search
CPC ..... F15B 15/1461; F15B 15/1485; B01D 29/684; B01D 29/114; B01D 29/117
See application file for complete search history.

(56) References Cited

U.S. PATENT DOCUMENTS 3,614,230 A * 10/1971 Crawford ..... G01N 1/20 356/36
4,454,033 A * 6/1984 Verduyn ..... B01D 24/4636 210/108

(Continued)

FOREIGN PATENT DOCUMENTS

CN 200978905 Y 11/2007
CN 101639106 A 2/2010

(Continued)

*Primary Examiner* — Abiy Teka
(74) *Attorney, Agent, or Firm* — Wayne & Ken, LLC; Tony Hom

(57) ABSTRACT

A dust-proof and heat-control device for hydraulic cylinder is provided, including: a fixing sleeve, an annular fan mechanism, a sealing end cap and a dust cover; wherein the fixing sleeve is sleeved on a cylinder barrel of the hydraulic cylinder, the annular fan mechanism is sleeved on the fixing sleeve, the sealing end cap is disposed on an end of the cylinder barrel, a piston rod of the hydraulic cylinder passes through the sealing end cap and the dust cover, the dust cover is fixed on the piston rod, the annular fan mechanism, the dust cover and the hydraulic cylinder enclose an inner space, a side wall of the dust cover is provided with an opening communicating with the inner space, and a filter screen is mounted at the opening. The device and method can achieve good dust proof and heat control effect on axially reciprocating telescopic hydraulic cylinder.

9 Claims, 6 Drawing Sheets

(56) References Cited

U.S. PATENT DOCUMENTS

| | | | | |
|---|---|---|---|---|
| 6,116,144 | A | 9/2000 | Rosenfeldt et al. | |
| 8,425,771 | B2 * | 4/2013 | O'Brien | C02F 1/002 210/200 |
| 9,669,335 | B2 * | 6/2017 | Takahashi | B01D 29/117 |
| 2013/0133250 | A1 * | 5/2013 | Chan | B01D 21/262 47/1.4 |
| 2015/0159753 | A1 * | 6/2015 | Mueller | F15B 15/1438 92/165 R |

FOREIGN PATENT DOCUMENTS

| | | | |
|---|---|---|---|
| CN | 202144812 | U | 2/2012 |
| CN | 203645475 | U | 6/2014 |
| CN | 204493566 | U | 7/2015 |
| CN | 205173348 | U | 4/2016 |
| CN | 205780006 | U | 12/2016 |
| CN | 205780524 | U | 12/2016 |
| CN | 106438565 | A | 2/2017 |
| CN | 206346981 | U | 7/2017 |
| DE | 102009059171 | A1 | 9/2011 |
| JP | 2002061608 | A | 2/2002 |
| JP | 2007231981 | A | 9/2007 |

* cited by examiner

DUST-PROOF AND HEAT-CONTROL DEVICE AND METHOD THEREOF

CROSS-REFERENCE TO RELATED APPLICATIONS

This application is a continuation of International Application No. PCT/CN2017/115018, filed on Dec. 7, 2017, which claims priority from Chinese Patent Application No. 201611121334.X, filed on Dec. 8, 2016, both of which are hereby incorporated by reference in their entireties.

TECHNICAL FIELD

The present disclosure relates to the technical field of dust-proof and heat-control, in particular to a dust-proof and heat-control device and a method thereof.

BACKGROUND

At present, in the field of axial reciprocating axially moving hydraulic cylinders (including oil hydraulic cylinders, pneumatic cylinders, water hydraulic cylinders, etc.), the piston rod of the hydraulic cylinder is often inevitably exposed to dust, smoke, mist, steam, and harsh working environment such as gas, humidity, acid and alkali, heat, and severe cold. The dust, smoke, water vapor, and acid and alkali components in the environment enter the cylinder barrel of the hydraulic cylinder with the expansion and contraction of the hydraulic cylinder, contaminating the hydraulic fluid (oil, air or water, etc.) Moreover, when the hydraulic cylinder is operating, the temperature of the hydraulic fluid will change drastically, which will affect the physical and chemical properties (such as viscosity) of the hydraulic fluid. These combined effects will weaken the performance of the hydraulic cylinder, affects the working efficiency and quality of the hydraulic cylinder, and even causes malfunction of the hydraulic cylinder.

SUMMARY

In view of the technical problems existing in the prior art, the object of the present disclosure is to provide a dust-proof and heat-control device for hydraulic cylinder, which can provide a good dust proof and heat control effect on the hydraulic cylinder.

Another object of the present disclosure is to provide a dust-proof and heat-control method using dust-proof and heat-control device.

In order to achieve the above object, the present disclosure adopts the following technical solutions:

A dust-proof and heat-control device for hydraulic cylinder, comprising: a fixing sleeve, an annular fan mechanism, a sealing end cap and a dust cover; wherein the fixing sleeve is sleeved on a cylinder barrel of the hydraulic cylinder, the annular fan mechanism is sleeved on the fixing sleeve, the sealing end cap is disposed on an end of the cylinder barrel, a piston rod of the hydraulic cylinder passes through the sealing end cap and the dust cover, the dust cover is fixed on the piston rod, the annular fan mechanism, the dust cover and the hydraulic cylinder enclose an inner space, a side wall of the dust cover is provided with an opening communicating with the inner space, and a filter screen is mounted at the opening. The device can provide good dust proof and heat control effect on the hydraulic cylinder. The filter screen can ensure that the piston rod of the hydraulic cylinder is always located in the relatively closed inner space during the telescopic process, so as to prevent contaminant from entering into the hydraulic cylinder and contaminating the hydraulic fluid due with expansion and contraction of the piston rod.

Further, the annular fan mechanism comprises an inner sleeve fixed on the fixing sleeve and an annular fan bracket fixed on a circumferential side surface of the inner sleeve, an end surface of the annular fan bracket being provided with a plurality of fan slots uniformly distributed along a circumferential direction. After the annular fan mechanism is mounted on the cylinder barrel, the annular fan mechanism is activated to eliminate dust and impurities in the inner space and control the heat temperature change of the hydraulic cylinder working piece. A screw hole can be arranged on a side wall of the inner sleeve, and the inner sleeve can be fixed on the fixing sleeve by screwing through the screw hole. The structure is simple, the mounting is reliable, and the mounting and disassembly are convenient.

Further, a fan is mounted on the fan slot, and a louver is mounted on an end surface of the fan. The louver plays a role of one-way circulation.

Further, an annular outer wall of the annular fan bracket is provided with a plurality of guiding grooves uniformly distributed along a circumferential direction, and an inner wall of the dust cover is provided with a plurality of guiding protrusions adapted to the guiding grooves. The dust cover can only move axially with the piston rod but cannot rotate.

Further, the fan is provided with a heater. The heater is provided to allow the fan to blow hot air, so that the hydraulic cylinder using the dust-proof heat-control device can also work normally under a relatively low temperature.

Further, an end surface of the sealing end cap is provided with a cylindrical projection, the projection protrudes towards an interior of the cylinder barrel, and an inner wall of the projection is in contact with the piston rod. The projection can further prevent leakage of hydraulic oil in the cylinder barrel.

Further, the device further comprises two buffer springs, one buffer spring being disposed between an end of the cylinder barrel and an end of the piston rod, the other buffer spring being sleeved on the projection. The buffer springs play a role of buffering.

Further, an outer end of the cylinder barrel is provided with a through hole, and a portion of the piston rod that emerges from the dust cover is provided with a through hole. Other objects can be hooked between the cylinder barrel and the piston rod for connection.

Further, the cylindrical dust cover is divided into two halves, and the two halves of the dust cover are connected by a hinge and a gasket. The dust cover has the advantages of simple structure, reliable mounting, and convenient use and maintenance.

A dust-proof and heat-control method using dust-proof and heat-control device, wherein an annular fan mechanism is sleeved on a working piece on which dust proof and heat control are to be performed, a dust cover is covered over the working piece, the annular fan mechanism, the dust cover and the working piece enclose an inner space, and when the working piece is in operation, the annular fan mechanism placed between the working piece and the dust cover operates to discharge dust impurities out from the inner space and control a temperature of the working piece. The dust-proof and heat-control method not only can regulate the heat temperature of the working piece in the inner space, but also can play the role of dust proof.

In general, the present disclosure has the following advantages:

The present disclosure can play a good dust proof and heat control effect on the working piece (such as the hydraulic cylinder), prevent the hydraulic fluid (the fluid such as oil, air, water, etc.) from being polluted by the external working environment, and keep a relatively stable temperature of the working piece (such as the hydraulic cylinder). In this way, the reliability of the hydraulic cylinder, the working efficiency and working quality of the hydraulic cylinder are improved, and the service life of the hydraulic cylinder is prolonged. The present disclosure has the advantages of simple structure, reliable mounting, convenient disassembly and assembly, and dust proof and heat control.

1—cylinder barrel of the hydraulic cylinder, 2—piston rod of the hydraulic cylinder, 3—fixing sleeve, 4—annular fan mechanism, 5—louver, 6—filter screen, 7—sealing end cap, 8—dust cover, 9—buffer spring, 10—inner space, 11—projection on the sealing end cap, 12—inner sleeve, 13—annular fan bracket, 14—guiding groove, 15—screw hole, 16—fan slot, 17—inlet and outlet, 18—guiding protrusion.

DETAILED DESCRIPTION OF EMBODIMENTS

The present disclosure will be further described in detail below with reference to the drawings and specific embodiments.

Figure 1:
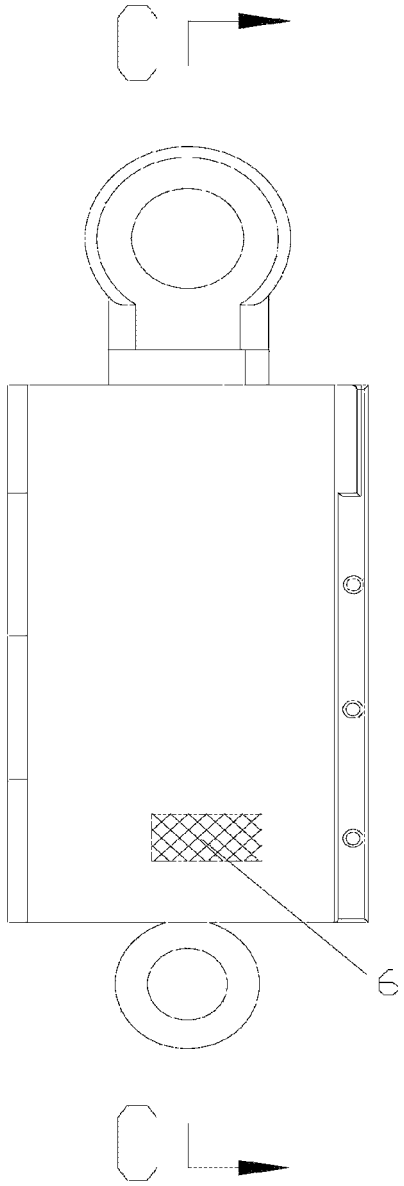
FIG. 1 is a front view of a dust-proof and heat-control device of the present disclosure.
Figure 2:
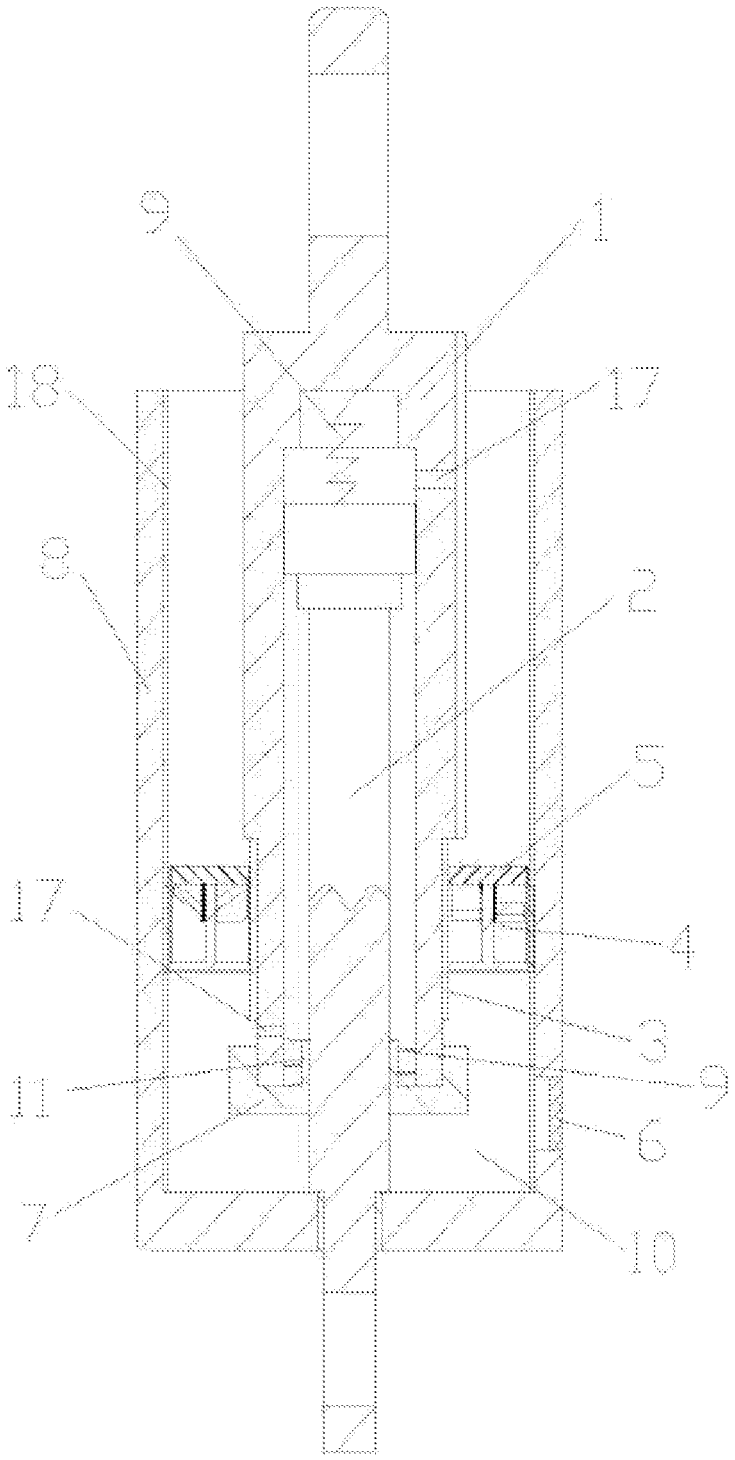
FIG. 2 is a sectional view of C-C of FIG. 1.
Figure 3:
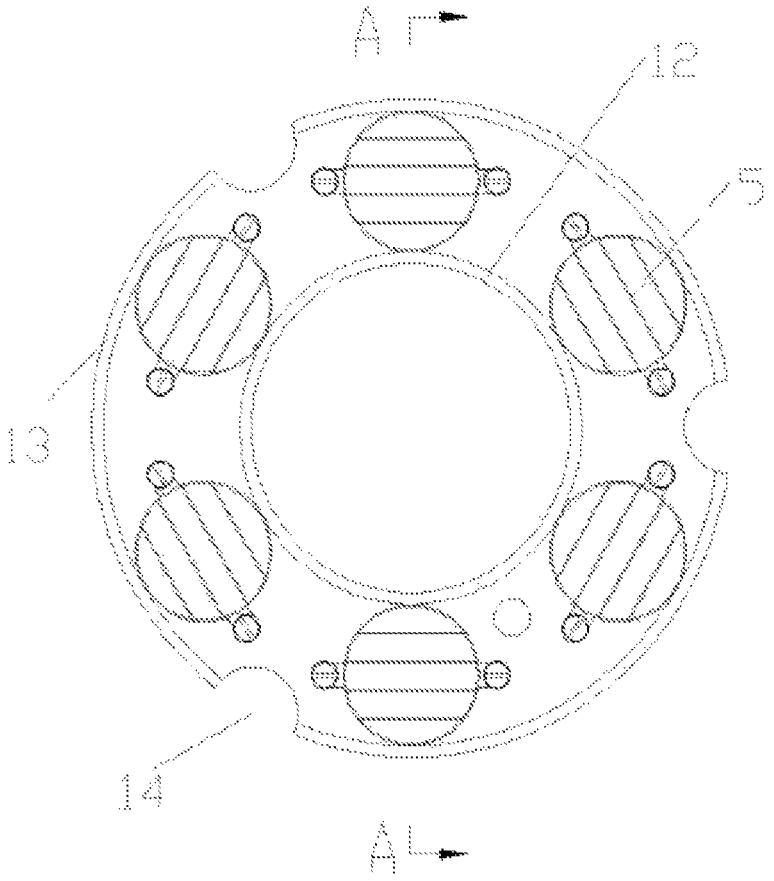
FIG. 3 is a front view of the annular fan mechanism with a louver.
Figure 4:
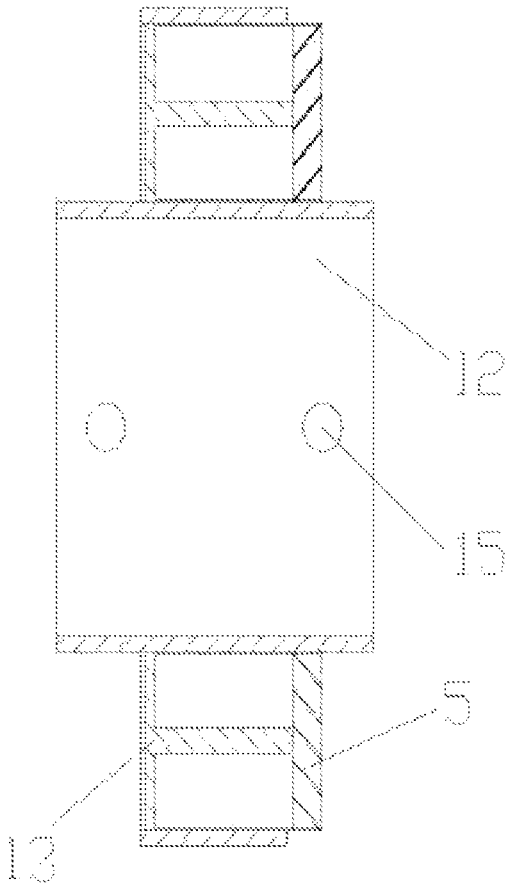
FIG. 4 is a sectional view of A-A of FIG. 3.

Referring to FIGS. 1 to 4, a dust-proof and heat-control device for hydraulic cylinder includes a fixing sleeve, an annular fan mechanism, a sealing end cap, and a dust cover; the hydraulic cylinder includes a cylinder barrel and a piston rod, and the piston rod moves linearly along an axial direction with respect to the cylinder barrel. The fixing sleeve is sleeved on an outer peripheral wall of the cylinder barrel of the hydraulic cylinder, and the annular fan mechanism is further sleeved on the fixing sleeve. The cylinder barrel, the fixing sleeve and the annular fan mechanism are mutually fixed. The sealing end cap is disposed on an end of the cylinder barrel, that is, the sealing end cap is disposed at an open end (the lower end of the cylinder barrel in FIG. 2) of the cylinder barrel, and the sealing end cap is used for sealing the cylinder barrel to prevent leakage of hydraulic fluid (such as oil, air, water, etc). in the cylinder barrel; the piston rod of the hydraulic cylinder passes through the sealing end cap and the dust cover, and good sealing between the piston rod and the sealing end cap is ensured. The dust cover is fixed to the piston rod and moves with the piston rod. As shown in FIG. 2, the annular fan mechanism, the dust cover and the hydraulic cylinder enclose an inner space, and an outer wall of the annular fan mechanism is in contact with an inner wall of the dust cover. The annular fan mechanism, a majority of the cylinder, and the sealing end cap is located in the inner space. One end of the dust cover (the upper end in FIG. 2) is not sealed, and the other end of the dust cover (the lower end in FIG. 2) is sealed. A side wall of the dust cover is provided with an opening communicating with the inner space, and a filter screen is mounted at the opening. The inner space is closed but not completely sealed. The filter screen filters gases and impurities entering the inner space.

Figure 5:
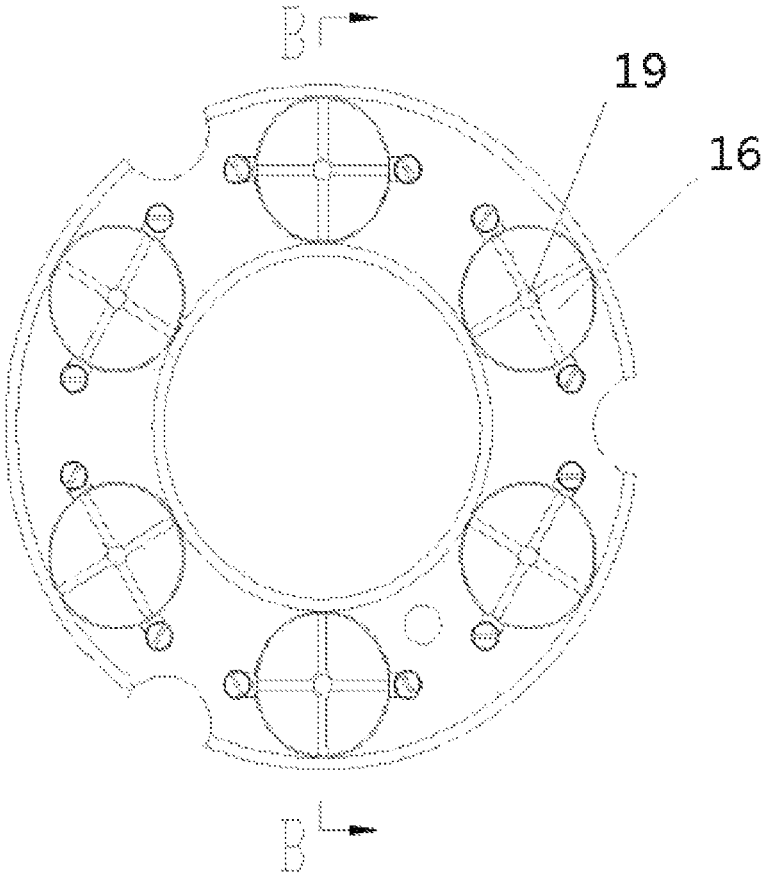
FIG. 5 is a front view of the annular fan mechanism with no louver.
Figure 6:
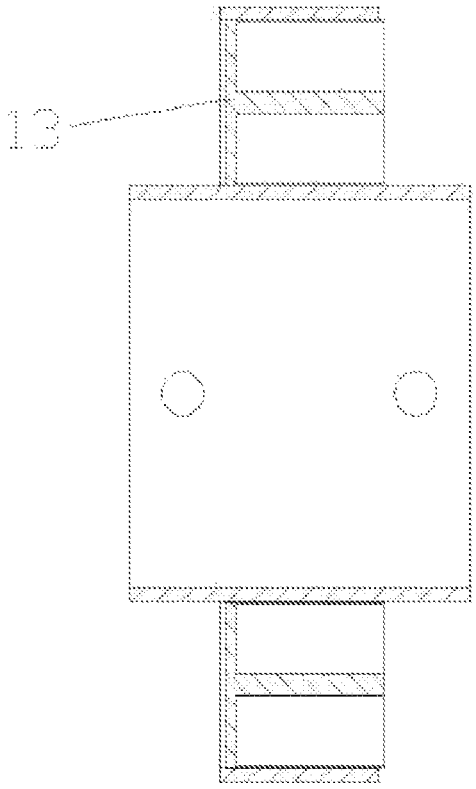
FIG. 6 is a sectional view of B-B of FIG. 5.

The annular fan mechanism comprises an inner sleeve and an annular fan bracket, the inner sleeve is fixed on the fixing sleeve, the annular fan bracket is fixed on a circumferential side of the inner sleeve, and an end surface of the annular fan bracket is provided with a plurality of fan slots uniformly distributed along a circumferential direction. A fan is mounted on the fan slot, and a louver is mounted on an end surface (the upper end of the fan in FIG. 2) of the fan. As shown in FIG. 5 and FIG. 6, the annular fan mechanism is not provided with a louver; after the annular fan mechanism is mounted on the cylinder, the annular fan mechanism is activated to eliminate dust and impurities in the inner space and control the temperature change of the hydraulic cylinder. The louver plays a role of one-way circulation, that is, dust impurities in the inner space can be discharged to the unsealed end (open end) of the dust cover, while they cannot enter the inner space from outside. In the present disclosure, the number of the fans is six.

The inner sleeve has a cylindrical shape, and a side wall of the inner sleeve is provided with a screw hole. The inner sleeve can be fixed on the fixing sleeve by screwing through the screw hole. The structure is simple, the mounting is reliable, and the mounting and disassembly are convenient.

An annular outer wall of the annular fan bracket is provided with a plurality of guiding grooves uniformly distributed along a circumferential direction, and an inner wall of the dust cover is provided with a plurality of guiding protrusions adapted to the guiding grooves. The guiding protrusions are semi-cylindrical, the guiding grooves are semi-circular, and the guiding protrusions are embedded in the guiding grooves, so that the dust cover can only move axially with the piston rod but cannot rotate. In the present disclosure, there are three guide grooves.

An end surface of the sealing end cap is provided with a cylindrical projection, the projection protrudes towards an interior of the cylinder barrel, and an inner wall of the projection is in contact with the piston rod. The piston rod passes through the sealing end cap from the projection of the sealing end cap and then passes through the dust cover. The projection can further prevent leakage of hydraulic oil in the cylinder barrel.

The device of the present disclosure is provided with two buffer springs, wherein one buffer spring is disposed between an end of the cylinder barrel and an end of the piston rod, however, this buffer spring can be fixed at an end (the upper end of the piston rod in FIG. 2) of the piston rod and can also be fixed on the end surface inside the cylinder (the top end inside the cylinder barrel in FIG. 2); the other buffer spring is sleeved on the projection. The buffer springs play a role of buffering, preventing rigid impact of the piston rod on the cylinder and the projection.

An outer end (the upper end of the cylinder in FIG. 2) of the cylinder barrel is provided with a through hole, and a portion (the lower end of the piston rod in FIG. 2) of the piston rod that emerges from the dust cover is provided with a through hole. Other objects can be hooked between the cylinder barrel and the piston rod for connection. The upper and lower ends of the cylinder are provided with inlet and outlet, which can be used for the inflow and outflow of hydraulic fluid.

As shown in FIG. 2, the dust cover is a cylindrical body whose upper end is open and whose lower end is sealed. The dust cover is divided into two halves, and the two half dust covers are connected by a hinge and a gasket. The dust cover has the advantages of simple structure, reliable mounting, and convenient use and maintenance.

When the device of the present disclosure is used, when the hydraulic cylinder is in operation, the piston rod drives the dust cover to move in the axial direction, the external airflow enters the inner space from the filter screen, and the fan works to discharge the dust impurities out from the inner space. The temperature variation of the hydraulic cylinder can be controlled, and heat and dust impurities are discharged from the inner space to the open end of the dust cover.

The device of the present disclosure mainly uses for dust proof and heat control, for hydraulic cylinder as well as other working pieces. A dust-proof and heat-control method using dust-proof and heat-control device is also provided, wherein an annular fan mechanism is sleeved on a working piece on which dust proof and heat control are to be performed, a fixing sleeve is provided or not depending on actual needs, a dust cover is covered over the working piece, the annular fan mechanism, the dust cover and the working piece enclose an inner space, and when the working piece is in operation, the annular fan mechanism placed between the working piece and the dust cover operates to discharge dust impurities out from the inner space and control a temperature of the working piece. The dust-proof and heat-control method not only can regulate the heat temperature of the working piece in the inner space, but also can play the role of dust proof.

The present disclosure can also provide a heater at the fan to blow out the hot air, so that the hydraulic cylinder using the dust-proof heat-control device can also work normally under a relatively low temperature, thereby maintaining the temperature of the hydraulic cylinder at a reasonable level and avoiding too much temperature difference which would otherwise affect the performance of the hydraulic cylinder.

The above embodiments are preferred embodiments of the present disclosure, but the embodiments of the present disclosure are not limited to the above embodiments. Any other changes, modifications, substitutions, combinations, and simplifications thereof made without departing from the spirit and scope of the present disclosure should all be considered as equivalent replacements and are included in the scope of the present disclosure.

What is claimed is:

1. A dust-proof and heat-control device for hydraulic cylinder, comprising: a fixing sleeve, an annular fan mechanism, a sealing end cap and a dust cover; wherein the fixing sleeve is sleeved on a cylinder barrel of the hydraulic cylinder, the annular fan mechanism is sleeved on the fixing sleeve, the sealing end cap is disposed on an end of the cylinder barrel, a piston rod of the hydraulic cylinder passes through the sealing end cap and the dust cover, the dust cover is fixed on the piston rod, the annular fan mechanism, the dust cover and the hydraulic cylinder enclose an inner space, a side wall of the dust cover is provided with an opening communicating with the inner space, and a filter screen is mounted at the opening.

2. The dust-proof and heat-control device for hydraulic cylinder according to claim 1, wherein the annular fan mechanism comprises a plurality of fans, an inner sleeve fixed on the fixing sleeve and an annular fan bracket fixed on a circumferential side surface of the inner sleeve, an end surface of the annular fan bracket being provided with a plurality of fan slots uniformly distributed along a circumferential direction.

3. The dust-proof and heat-control device for hydraulic cylinder according to claim 2, wherein the fans are respectively mounted on the fan slots, and a louver is mounted on an end surface of each of the fans.

4. The dust-proof and heat-control device for hydraulic cylinder according to claim 3, wherein each of the fans is provided with a heater.

5. The dust-proof and heat-control device for hydraulic cylinder according to claim 2, wherein the annular outer wall of the annular fan bracket is provided with a plurality of guiding grooves uniformly distributed along a circumferential direction, and an inner wall of the dust cover is provided with a plurality of guiding protrusions adapted to the guiding grooves.

6. The dust-proof and heat-control device for hydraulic cylinder according to claim 1, wherein an end surface of the sealing end cap is provided with a cylindrical projection, the projection protrudes towards an interior of the cylinder barrel, and an inner wall of the projection is in contact with the piston rod.

7. The dust-proof and heat-control device for hydraulic cylinder according to claim 6, wherein the device further comprises two buffer springs, one buffer spring being disposed between an end of the cylinder barrel and an end of the piston rod, the other buffer spring being sleeved on the projection.

8. The dust-proof and heat-control device for hydraulic cylinder according to claim 1, wherein an outer end of the cylinder barrel is provided with a through hole, and a portion of the piston rod that emerges from the dust cover is provided with a through hole.

9. The dust-proof and heat-control device for hydraulic cylinder according to claim 1, wherein the dust cover which is cylindrical is divided into two halves, and the two halves of the dust cover are connected by a hinge and a gasket.

* * * * *